US008069506B2

(12) United States Patent
Hammond

(10) Patent No.: US 8,069,506 B2
(45) Date of Patent: Dec. 6, 2011

(54) SECTIONAL PLUMBING FIXTURE ENCLOSURE REMOVABLY SECURED WITH CLIP

(75) Inventor: Steven M. Hammond, Sheboygan Falls, WI (US)

(73) Assignee: Kohler Co., Kohler, WI (US)

( * ) Notice: Subject to any disclaimer, the term of this patent is extended or adjusted under 35 U.S.C. 154(b) by 1343 days.

(21) Appl. No.: 11/633,329

(22) Filed: Dec. 4, 2006

(65) Prior Publication Data

US 2008/0127406 A1 Jun. 5, 2008

(51) Int. Cl.
*A47K 1/02* (2006.01)

(52) U.S. Cl. ..... 4/584; 4/612; 4/614; 4/592; 52/35

(58) Field of Classification Search ..... 4/538, 557, 4/584, 592, 595, 596, 612–614; 52/35, 264
See application file for complete search history.

(56) References Cited

U.S. PATENT DOCUMENTS

| | | | | |
|---|---|---|---|---|
| 1,781,692 | A | 11/1930 | Lewis | |
| 2,014,554 | A | 9/1935 | Bulthuis | |
| 879,561 | A | 3/1959 | Rieder | |
| 3,382,635 | A * | 5/1968 | O'Gara et al. | 52/270 |
| 3,585,657 | A | 6/1971 | Jensen et al. | |
| 3,588,925 | A * | 6/1971 | Kuypers | 4/595 |
| 3,688,459 | A | 9/1972 | Mattix | |
| 3,994,050 | A | 11/1976 | Bub | |
| 4,316,295 | A | 2/1982 | Whitney et al. | |
| 4,706,342 | A | 11/1987 | Yu | |
| 4,825,480 | A * | 5/1989 | Moore | 4/595 |
| 4,901,380 | A | 2/1990 | Smith | |
| 5,653,550 | A | 8/1997 | Mutz et al. | |
| 6,389,658 | B1 | 5/2002 | Pfaller et al. | |
| 6,691,339 | B1 | 2/2004 | Thomas | |
| 7,634,823 | B2 * | 12/2009 | Sisk | 4/614 |
| 2005/0210577 | A1 | 9/2005 | Sisk | |
| 2006/0195980 | A1 * | 9/2006 | Nagley | 4/595 |

FOREIGN PATENT DOCUMENTS

CA 2123977 11/1995

OTHER PUBLICATIONS

Eight pages of a translation of a Chinese notification and Office Action dated Jun. 2, 2010 in a corresponding application CN200780044621.8.

* cited by examiner

*Primary Examiner* — Gregory Huson
*Assistant Examiner* — Timothy Kelly
(74) *Attorney, Agent, or Firm* — Foley & Lardner LLP

(57) ABSTRACT

Disclosed is a clip suitable to removably assemble a bathtub or shower stall base to a shower enclosure surround wall. The clip includes a toe, a leg connected to the toe, a web connected to the leg, and a flexible tang also connected to the web. The web is designed to mount the clip on the bathtub or stall base, while the toe catches under a ledge of the bathtub or stall base. The tang will then project at an angle inwardly. The tang permits the surround wall to pass vertically downward past it to assemble the enclosure. It resists upward movement until a specified force is applied, at which point the clip deforms or breaks to permit disassembly. The clip also has a portion of the web which facilitates keeping the clip on the bathtub or stall base even after the clip has been deformed or partially broken.

16 Claims, 5 Drawing Sheets

FIG. 3a
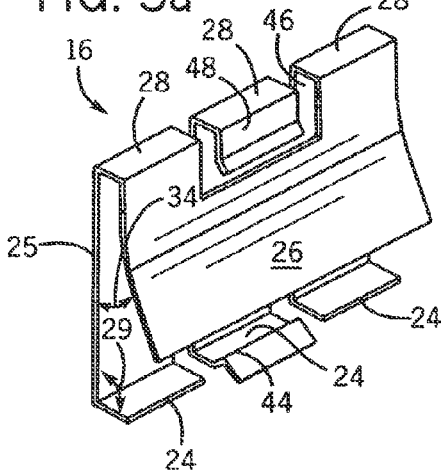
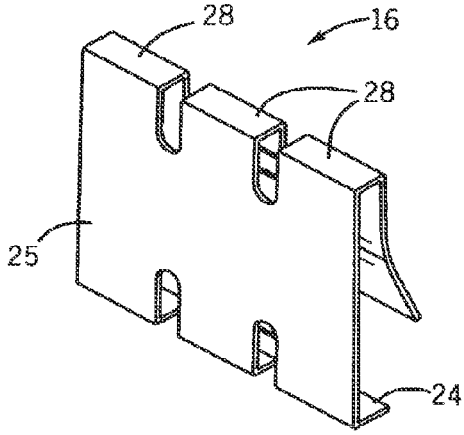
FIG. 3b
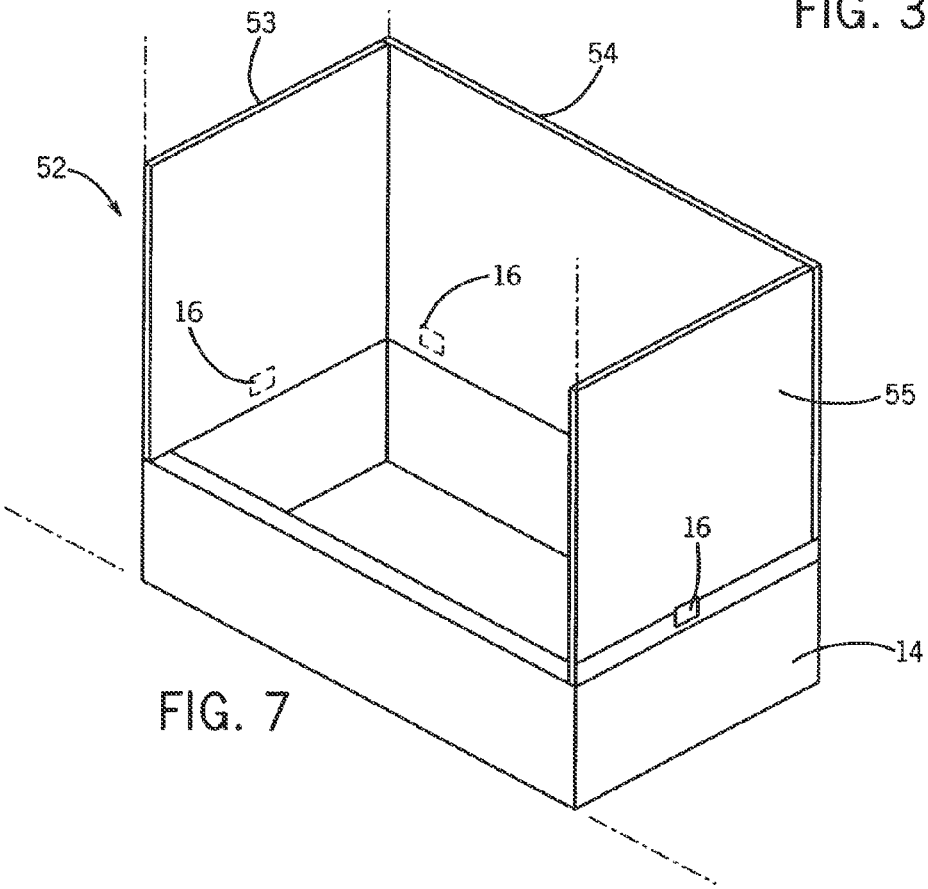
FIG. 7

SECTIONAL PLUMBING FIXTURE ENCLOSURE REMOVABLY SECURED WITH CLIP

CROSS-REFERENCE TO RELATED APPLICATION

Not applicable.

STATEMENT OF FEDERALLY SPONSORED RESEARCH OR DEVELOPMENT

Not applicable.

BACKGROUND OF THE INVENTION

The present invention relates to plumbing fixtures such as bathing or shower enclosures which are manufactured in multiple pieces and then assembled at the site of installation. More particularly it relates to such enclosures that permit partial disassembly even after installation to perform maintenance behind the enclosure.

Baths are sometimes designed with integral surrounding shower enclosure walls. This is also sometimes the case for shower enclosures where a base/pan is formed integrally with the surrounding walls. However, some of these enclosures are so large that they will not fit through standard doorways or in standard elevators, thereby limiting their use with respect to the replacement market, and in any event making shipment of such products difficult.

A variety of bathtub and shower enclosures have therefore been developed with the tub or shower pan formed separately from the surrounding walls. Those components are then assembled at the site of installation.

For example, U.S. Pat. No. 6,691,339 disclosed a knockdown bathing enclosure in which clips were used to facilitate the assembly of the enclosure walls to the bathtub. However, these clips did not provide a secure means of limiting relative vertical movement under normal circumstances.

U.S. Pat. No. 3,382,635 disclosed a knockdown type shower enclosure, again relying on some clips for the connection. However, again the security of the connection was not optimal.

U.S. Pat. No. 4,316,295 showed another means of assembling a knockdown shower stall. Again, the nature of the connection was not optimal.

See also U.S. Pat. Nos. 1,781,692 and 4,901,380, as well as U.S. patent application publication 2005/0210577.

While a variety of knockdown type bathing and shower enclosures are known, it is still desired to develop improved plumbing fixtures of this type, particularly where the assembly is secure under normal installed conditions, but the enclosure can be disassembled even after installation without causing damage to the main enclosure elements (to permit maintenance or inspection behind the enclosure).

SUMMARY OF THE INVENTION

In one aspect the present invention provides a plumbing fixture enclosure that has a base, an upper enclosure wall portion mountable on the base, and at least one clip configured to removably link the upper enclosure wall portion to the base. The clip has a toe that can catch under a portion of the base, a leg linked to the toe, a tang, and a web linking the leg to the tang. The clip is mountable on a portion of the base.

The tang is suitable to deflect towards the leg as the upper enclosure wall portion is assembled to the base. The tang is also suitable to deflect away from the leg and then upward as the upper enclosure wall portion is disassembled from the base.

In preferred forms the plumbing fixture base is selected from the group consisting of bathtubs and shower stall bases, and the upper enclosure wall portion is suitable to extend around a left side, rear, and right side of the enclosure. In this embodiment, the plumbing fixture base has at least one (preferably two) essentially horizontal platform(s), and when there are at least two the upper enclosure wall portion has two essentially horizontal legs suitable to rest on the essentially horizontal platforms when the upper enclosure wall portion is mounted on the plumbing fixture base.

One of the two essentially horizontal legs is configured to catch under the tang when the clip, upper enclosure wall portion and plumbing fixture base are assembled, an upper one of the essentially horizontal platforms melds into an essentially upwardly and vertically extending rim, a lower portion of the rim is in the form of a downward projection which can assist in retaining the clip when the clip is mounted on the rim, and the web of the clip rests on an upper portion of the rim.

In another aspect the invention provides a clip suitable to assemble a shower surround wall to a plumbing fixture base. The clip has a toe, a leg linked to the toe, a tang, and a web linking the leg to the tang. The clip is configured such that the tang can deflect towards the leg as the enclosure is being assembled, and away from the leg and upward as the enclosure is being disassembled.

The leg is preferably linked to the toe at an angle not exceeding 100°, most preferably not exceeding about 90°. Further, it is preferred that a portion of the tang extend at an angle relative to the leg of less than 90°.

A portion of the tang may be interrupted by a retaining portion of the web so as to provide a means for the clip to stay on the rim even though the tang is grossly deformed or broken to permit the disassembly of the upper surround from the lower base. Also, the toe may be provided with a grip that catches on the lower rim projection so that the clip is resistant to upward movement off the bathtub, apart from the tang and nearby web.

In yet another form the invention provides a method of disassembling such plumbing fixture enclosures. One provides such an enclosure in assembled form, lifts the shower enclosure wall upward relative to the plumbing fixture base to thereby bend the tang radially inward and upward by deforming the clip, and then continues to lift the shower enclosure wall upward relative to the plumbing fixture base until it is disassembled from the plumbing fixture base. One may remove the clip after it has been deformed from the plumbing fixture base.

Simply by dropping the upper enclosure down on the base when the clips are suitably positioned one can assemble the upper enclosure to the base. Gravity, plus the resisting force of the tangs, will resist most disassembly forces. If one thereafter wants to perform maintenance behind the enclosure without destroying the main parts of the enclosure, one can forcefully lift the upper enclosure upward, which will cause the tangs to bend away from a blocking position, thereby freeing the upper enclosure.

However, the lower grip on the toe, and the web and associated retainer will tend to keep the deformed clip on the base, rather than causing them to fall behind the bathtub. One can then manually remove the clips and replace them with new clips when reassembly is desired.

A main function of these clips is to "lock" the surrounding wall or walls to the bathtub or receptor during installation.

One will then typically nail the combined enclosure structure to a surrounding wall stud pocket. After installation the nail in features largely fix the surrounding walls and bathtub or receptor relative to each other (regardless of the presence of the clips).

It should be appreciated that these enclosures serve all the primary needed functions for a knockdown enclosure. They can be manufactured in multiple parts, and thus more easily be shipped to the installation site. Further, these enclosures can quickly be installed with minimal cost and labor. The assembly of the present invention also provides a secure construction in normal use.

However, when it is desired to inspect or repair plumbing or other structures behind the enclosure, even long after installation, an enclosure wall can be disassembled from the tub or shower base with less risk of damaging the base or upper enclosure walls. After the maintenance work, new (or re-bent old) clips can be placed on the bathtub with the surround being reassembled to the base.

The clips of the present invention are inexpensive to manufacture, and their use does not significantly increase the cost of the enclosure walls or base. They may be made from a variety of flexible materials, preferably a rust-resistant material such as stainless steel or aluminum.

The base and upper shower enclosure walls can be made in a conventional manner, using conventional materials, except for the configuration of the lower end of the enclosure and the upper end of the bathtub (both of which are suitable to be molded). Hence, the principles of the present invention may be applied to many existing designs with minimal cost for adaptation.

These and still other advantages of the present invention will be apparent from the detailed description which follows and the accompanying drawings.

BRIEF DESCRIPTION OF THE DRAWINGS

FIG. 3*a* is front perspective view of a clip of FIG. 1;

FIG. 3*b* is rear perspective view of that clip;

FIG. 7 is a view similar to FIG. 1, albeit of a second embodiment in which the upper enclosure part is formed in three separate walls, rather than a single three-sided structure;

DETAILED DESCRIPTION OF THE PREFERRED EMBODIMENTS

Figure 1:
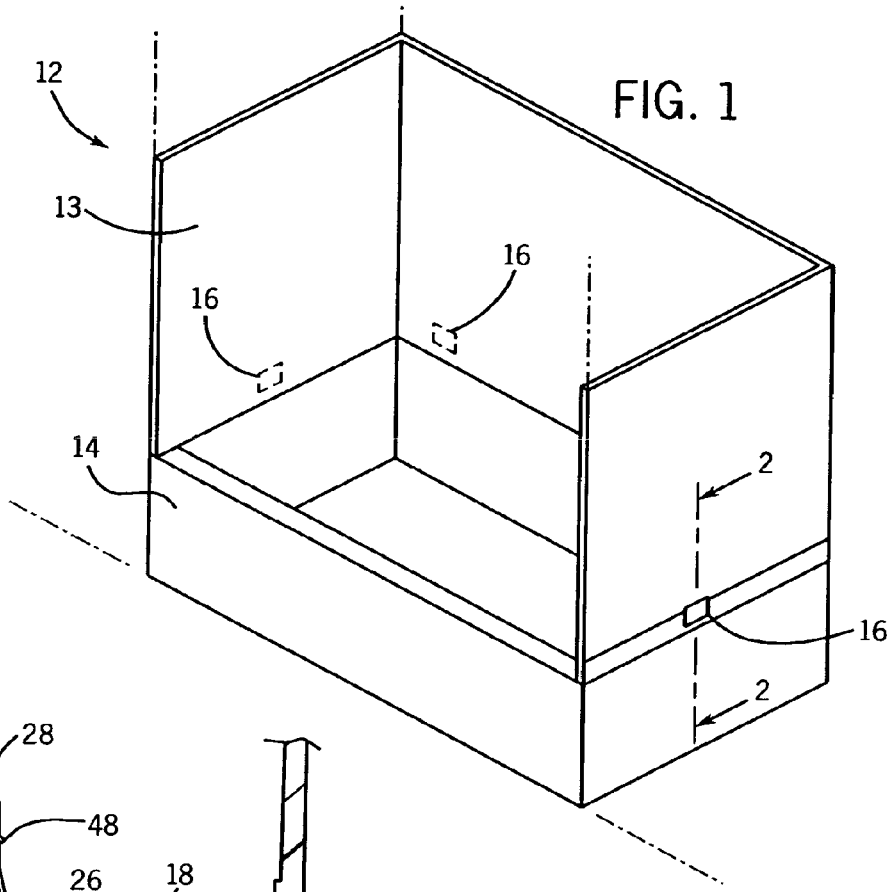
FIG. 1 is a perspective view of a first embodiment of a plumbing fixture according to the present invention.
Figure 2:
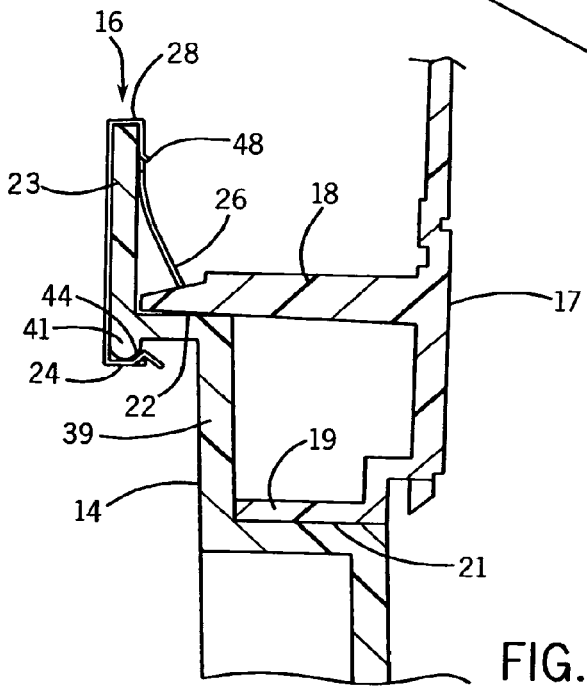
FIG. 2 is a fragmentary cross-sectional view taken along line 2-2 of FIG. 1.

Referring first to FIGS. 1 and 2, there is shown a plumbing fixture 12. There is a bathtub 14 on which is mounted a shower surround wall 13. Clips 16 are configured to secure the shower surround wall 13 to the bathtub 14. For the side walls we prefer to use one clip 16, and for the rear wall we prefer to use two such clips symmetrically positioned (one being shown).

While considering the terms "enclosure" or "surround" in this application, it is to be understood that such structures do not always, or even frequently, completely surround or enclose the showering/bathing areas. Instead, a door structure or a curtain, not shown, typically completes the structure. We use these terms to refer to the fixture with or without these extra final closing features.

The shower surround wall 13 has a lower portion 17, with two feet 18 and 19. The bathtub 14 has an upper portion, with two platforms 21 and 22. Foot 18 is intended to rest on platform 22 in the assembled condition, and foot 19 is intended to rest on the platform 21 in the assembled condition. The bathtub also has an upper rim 23.

Referring next to FIGS. 2-3*b*, clips 16 are configured to retain, in a removable fashion, the foot 18 adjacent the platform 22. Each clip 16 includes one or more toes 24, a leg 25, and a tang 26 linked to the leg by a web 28. A first angle 29 between the leg 25 and toes 24 is approximately, but preferably not greater than, 90°. A second angle 34 between the tang 26 and vertical is preferably much less than 90°, and also preferably less than 45°. Some or all of toes 24 may also be formed with a grip 44.

Figure 6:
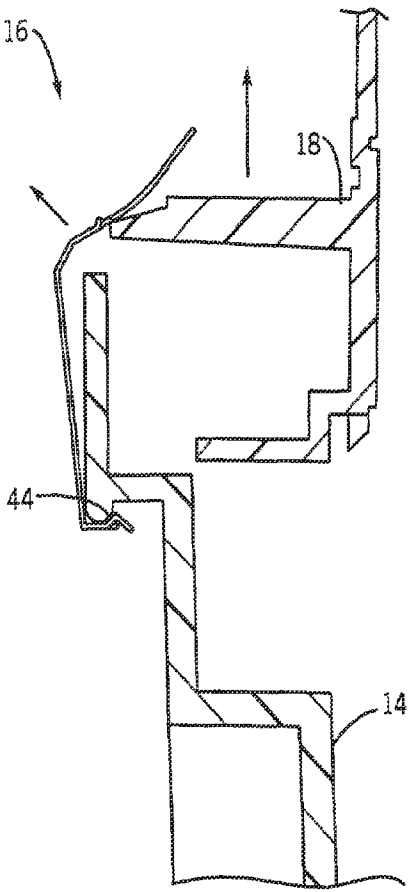
FIG. 6 is a view similar to FIG. 5, albeit showing the upper enclosure further removed from the lower bathtub.

In the FIG. 3*a* embodiment (but not the FIG. 10 embodiment) aperture 46 can extend at least partially through the clip to thereby defines a retaining tab 48. This helps keep the clip on the rim even when the parts are as shown in FIG. 6.

FIG. 2 illustrates the fully assembled form of the assembly. In this form tang 26 resists upward movement of the foot 18, and thus upward movement of the shower surround wall 13. The shower surround wall 13 is also restricted from radially outward movement by contact between feet 18 and 19 with the rim 23 and the wall 39. Radially inward movement is also to some extent prevented as in the FIG. 1 embodiment the shower surround wall 13 is of one piece, such that any attempted radially inward movement by one side wall constitutes inhibited outward movement of the other side wall.

Downward movement of the surround is resisted by the feet 18 and 19 contacting the platforms 21 and 22. The weight of the surround is divided between the two platforms, thereby reducing stress on these parts.

The clip is resistant to upward removal off the rim 23. This is because the toes 24 catch under the rim projection 41. Further, the toe grip 44 tends to inhibit the toes from decoupling from the projection 41.

Figure 4:
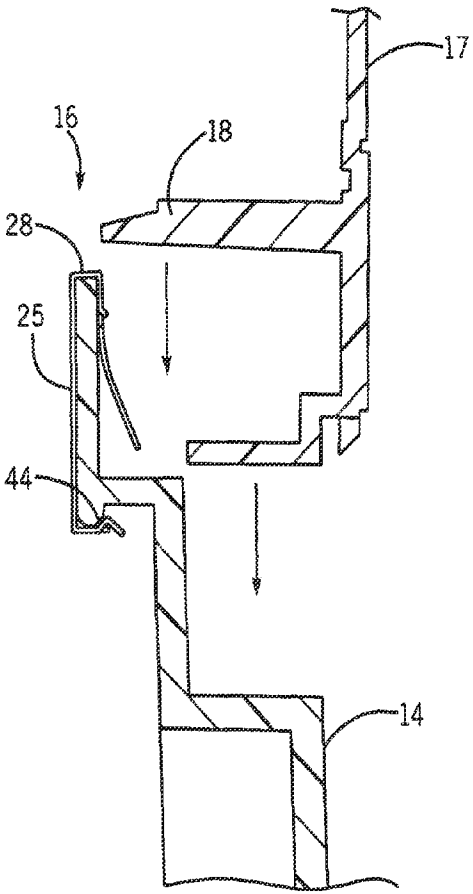
FIG. 4 is a view similar to FIG. 2, albeit prior to the upper enclosure being mounted on the bathtub of FIG. 1.

One can preposition one or several of the clips 16 as shown in FIG. 1. When the upper surround is then dropped onto the base, as shown in FIG. 4, this results in the tang 26 being driven radially outwardly. Specifically, downward movement of the foot 18 drives the tang 26 outward until the foot 18 clears the tang 26. The tang 26 then snaps back to the FIG. 2 blocking position to retain the foot 18.

Figure 5:
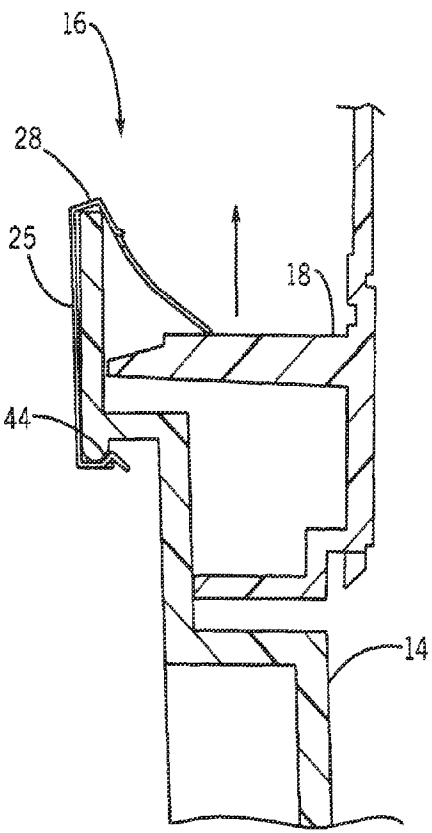
FIG. 5 is a view similar to FIG. 2, albeit as the upper enclosure is being removed from the lower bathtub.

As shown in FIGS. 5 and 6, if one then tries to lift up the shower surround wall 13, that movement will at first be resisted. Hence, the tangs serve a securing function during normal use. Greater lifting force will cause the tang to first begin to bend, causing the web 28 to deform, and ultimately allowing the shower surround wall 13 to move up free from the bathtub 14 without destroying the shower surround wall 13 or bathtub 14. While this may destroy the clips, they are so inexpensive that it is practical to replace them when reassembly is desired.

Even after the clip is deformed to the FIG. 6 position, retaining tab 48 (if present) will still try to keep the clip 16 from falling off behind the bathtub 14. This may make it easier to replace the clips without requiring access behind the tub to find clips that may have dropped off (or leaving stray used clips behind).

Plumbing or other items (e.g. electrical connections or air pumps) behind the shower surround can then be serviced. The surround can then be reassembled to the position shown in FIG. 1.

As shown in FIG. 7, the surround 52 need not be a single piece structure. Rather, their may be a left side wall 53 a separate rear wall 54 and a separate right side wall 55. The two side walls 53 and 55 may abut against the rear wall 54, to restrict their rearward movement.

Figure 8:
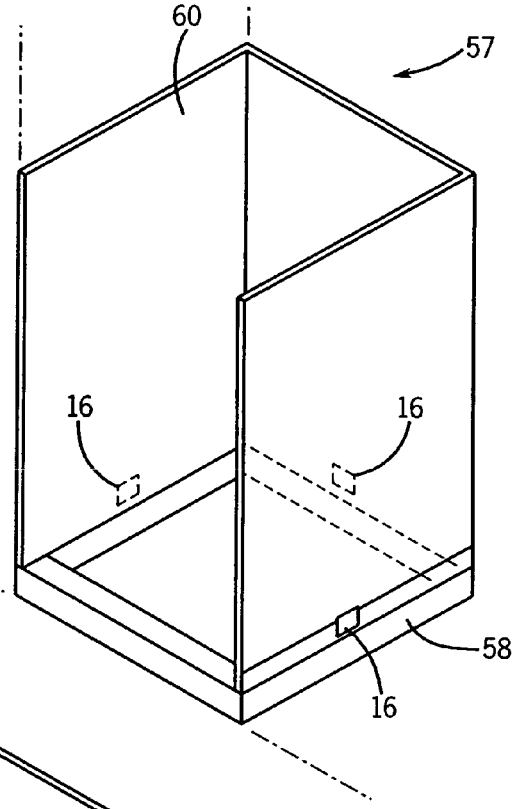
FIG. 8 is a view similar to FIG. 1, albeit of another embodiment which forms a shower enclosure without a bathtub.

In the FIG. 8 embodiment the fixture is in the form of a shower enclosure 57 in which the upper surround 60 is positioned on a shower stall base 58, rather than on a bathtub. The upper edge of the stall base could be made to mimic the configuration of the upper portion of the bathtub 14, to achieve an appropriate connection.

Figure 9:
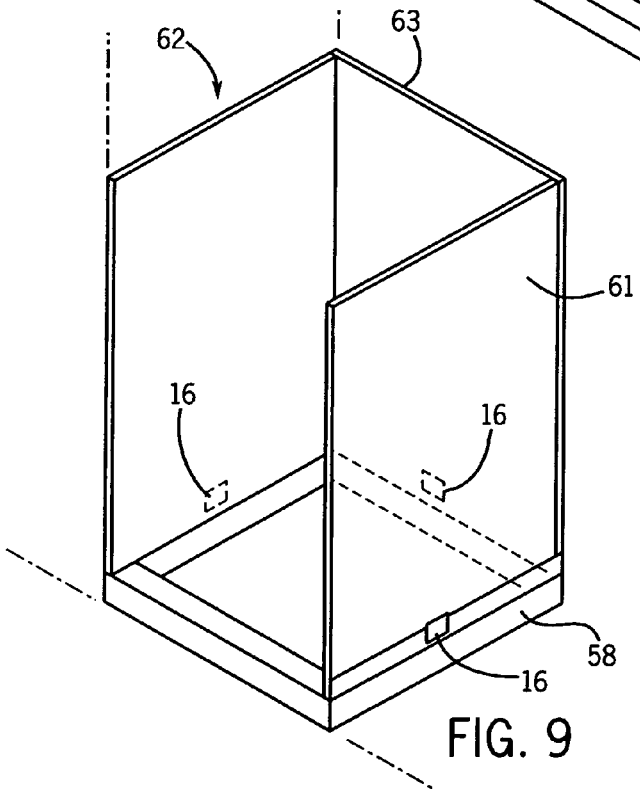
FIG. 9 is a view similar to FIG. 7, albeit of another embodiment which is a shower enclosure, albeit where the upper enclosure is in three pieces.

In the FIG. 9 embodiment the assembly is similar to that in FIG. 8, except that the enclosure is now in three part form, with a right wall 61, a left wall 62 and a rear wall 63.

Figure 10:
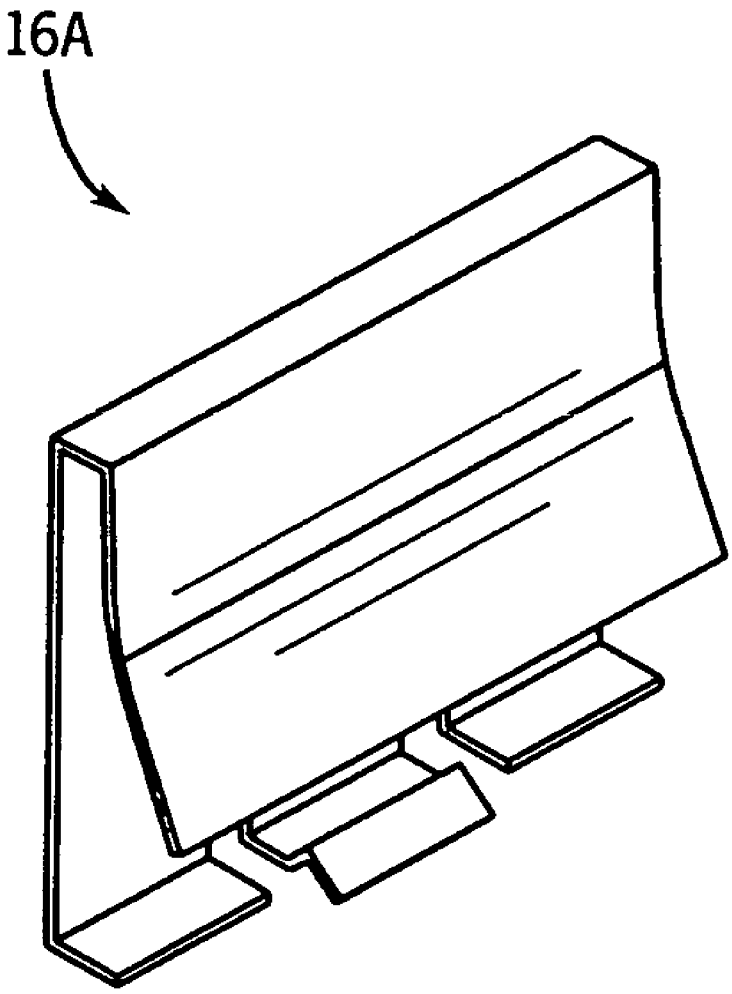
FIG. 10 is a view similar to FIG. 3A, but of an alternative clip.

As shown in the FIG. 10 embodiment, the clip need not have the aperture 46 and corresponding retaining tab 48. Otherwise, clip 16A is essentially identical to that of FIG. 3*a*.

Many modifications and variations to the preferred embodiments will be apparent to those skilled in the art, which are intended to be within the spirit and scope of the invention. For example, while the invention has been depicted in the context of a bathtub enclosure or a shower stall enclosure, it may also have applicability for other plumbing fixtures (e.g. saunas; environmental enclosures). Therefore, the present invention is not to be limited to just the described most preferred embodiments. To ascertain the full scope of the invention, the claims which follow are referenced.

INDUSTRIAL APPLICABILITY

The invention provides multi-part plumbing fixture enclosures, and clips for removably assembling their parts.

What is claimed is:

1. A plumbing fixture enclosure, comprising:
a base;
an upper enclosure wall portion mountable on the base; and
at least one clip configured to removably link the upper enclosure wall portion to the base;
wherein the clip comprises:
a toe that is configured to catch under a portion of the base;
a leg linked to the toe;
a tang; and
a web linking the leg to the tang and mountable on a portion of the base;
wherein the tang is configured to deflect towards the leg as the upper enclosure wall portion is assembled to the base, and the tang is configured to deflect away from the leg and then upward as the upper enclosure wall portion is disassembled from the base.

2. The plumbing fixture enclosure of claim 1, wherein the plumbing fixture base is selected from the group consisting of bathtubs and shower stall bases.

3. The plumbing fixture enclosure of claim 1, wherein the upper enclosure wall portion is suitable to extend around a left side, rear, and right side of the enclosure.

4. The plumbing fixture enclosure of claim 1, wherein the leg comprises a first end coupled to the web and a second end and a second end coupled to the toe.

5. A plumbing fixture enclosure, comprising:
a base;
an upper enclosure wall portion mountable on the base; and
at least one clip configured to removably link the upper enclosure wall portion to the base;
wherein the clip comprises:
a toe that is configured to catch under a portion of the base;
a leg linked to the toe;
a tang; and
a web linking the leg to the tang and mountable on a portion of the base;
wherein the tang is configured to deflect towards the leg as the upper enclosure wall portion is assembled to the base, and the tang is configured to deflect away from the leg and then upward as the upper enclosure wall portion is disassembled from the base; and
wherein the plumbing fixture base has two essentially horizontal platforms and the upper enclosure wall portion has two essentially horizontal legs configured to rest on the two essentially horizontal platforms when the upper enclosure wall portion is mounted on the plumbing fixture base.

6. The plumbing fixture enclosure of claim 5, wherein one of the two essentially horizontal legs is also configured to catch under the tang when the clip, upper enclosure wall portion and plumbing fixture base are assembled.

7. The plumbing fixture enclosure of claim 5, wherein an upper one of the essentially horizontal platforms melds into an essentially upwardly and vertically extending rim.

8. The plumbing fixture enclosure of claim 7, wherein a lower portion of the rim is in the form of a projection which can assist in retaining the clip when the clip is mounted on the rim.

9. The plumbing fixture enclosure of claim 7, wherein the web of the clip rests on an upper portion of the rim.

10. The plumbing fixture enclosure of claim 5, wherein the two essentially horizontal legs extend substantially horizontally from the upper enclosure wall portion.

11. A clip suitable to assemble a shower surround wall to a plumbing fixture base, the clip comprising:
a toe configured to catch under a portion of the base;
a leg linked to the toe;
a tang; and
a web linking the leg to the tang;
wherein the tang is configured to deflect towards the leg as the shower surround is assembled to the base and away from the leg and upward as the shower surround is disassembled from the base; and
wherein a portion of the tang is interrupted by a retaining portion of the web.

12. The clip of claim 11, wherein the plumbing fixture base is selected from the group consisting of shower stall bases and bathtubs.

13. The clip of claim 11, wherein the leg is linked to the toe at an angle not exceeding 100°.

14. The clip of claim 11, wherein a portion of the tang extends at an angle relative to the leg of less than 90°.

15. The clip of claim 11, wherein said toe includes a grip.

16. The clip of claim 11, wherein the leg comprises a first end coupled to the web and a second end and a second end coupled to the toe.

* * * * *